US011642881B2

(12) United States Patent
Vinets Alonso et al.

(10) Patent No.: US 11,642,881 B2
(45) Date of Patent: May 9, 2023

(54) SAFETY ZONE FOR A MAINTENANCE TASK

(71) Applicant: HEWLETT-PACKARD DEVELOPMENT COMPANY, L.P., Spring, TX (US)

(72) Inventors: Andreu Vinets Alonso, Sant Cugat del Valles (ES); Antonio Gracia Verdugo, Sant Cugat del Valles (ES); Josep Maria Bel Calavia, Sant Cugat del Valles (ES)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 166 days.

(21) Appl. No.: 17/311,460

(22) PCT Filed: Jan. 30, 2019

(86) PCT No.: PCT/US2019/015899

§ 371 (c)(1),
(2) Date: Jun. 7, 2021

(87) PCT Pub. No.: WO2020/159503

PCT Pub. Date: Aug. 6, 2020

(65) Prior Publication Data

US 2022/0024200 A1 Jan. 27, 2022

(51) Int. Cl.

| | |
|---|---|
| ***B41J 2/045*** | (2006.01) |
| ***B41J 2/165*** | (2006.01) |
| ***B41J 2/21*** | (2006.01) |

(52) U.S. Cl.

CPC ..... *B41J 2/0451* (2013.01); *B41J 2/16579* (2013.01); *B41J 2/2139* (2013.01); *B41J 2/2142* (2013.01)

(58) Field of Classification Search

CPC ..... B41J 2/04598; B41J 2/04541; B41J 2/04573; B41J 2/04586; B41J 2/0451; B41J 2/16579; B41J 2/2139; B41J 2/2142

See application file for complete search history.

(56) References Cited

U.S. PATENT DOCUMENTS

| | | | |
|---|---|---|---|
| 6,102,518 | A | 8/2000 | Taylor |
| 6,347,857 | B1 | 2/2002 | Purcell et al. |
| 7,407,258 | B2 | 8/2008 | Nakahara et al. |
| 8,408,673 | B2 | 4/2013 | Aoki |
| 8,714,689 | B2 | 5/2014 | Abe |

(Continued)

FOREIGN PATENT DOCUMENTS

| | | |
|---|---|---|
| CN | 101056766 | 10/2007 |
| CN | 105793811 | 7/2016 |

(Continued)

*Primary Examiner* — Thinh H Nguyen

(57) ABSTRACT

Examples relate to a method to print a print job. The method comprise comparing an operational parameter of the print job with a reference operational parameter and determining to perform a maintenance task during the print job based on at least a result of comparing the operational parameter with the reference operational parameter. If the maintenance task is to be performed, the method further comprises determining a safety area on a printable medium and performing a maintenance task on a printable medium.

15 Claims, 4 Drawing Sheets

(56) References Cited

U.S. PATENT DOCUMENTS

| | | | | |
|---|---|---|---|---|
| 8,888,222 | B2 | 11/2014 | Ito | |
| 8,944,553 | B2 | 2/2015 | Walker et al. | |
| 9,050,795 | B2 | 6/2015 | Ueshima | |
| 9,987,847 | B2 | 6/2018 | Takahashi | |
| 2004/0189737 | A1 | 9/2004 | Nakashima | |
| 2005/0018006 | A1 | 1/2005 | Im | |
| 2006/0061618 | A1* | 3/2006 | Hernandez | B33Y 40/00 347/29 |
| 2013/0044345 | A1 | 2/2013 | Sakai | |
| 2014/0104334 | A1 | 4/2014 | Ikarashi | |
| 2014/0139580 | A1 | 5/2014 | Sato et al. | |
| 2016/0279978 | A1 | 9/2016 | Stephens | |
| 2017/0334199 | A1 | 11/2017 | Ikeda | |

FOREIGN PATENT DOCUMENTS

| | | | |
|---|---|---|---|
| EP | 0569201 | A1 | 11/1993 |
| EP | 1955849 | A2 | 8/2008 |
| JP | 2015-009388 | A | 1/2015 |
| JP | 2017164935 | | 9/2017 |
| JP | 6241078 | B2 | 12/2017 |
| RU | 02178741 | C2 | 1/2002 |
| RU | 2542551 | C2 | 2/2015 |
| WO | WO-2001021405 | A2 | 3/2001 |
| WO | WO-2006033903 | A2 | 3/2006 |

* cited by examiner

SAFETY ZONE FOR A MAINTENANCE TASK

BACKGROUND

A printing system may include a print head with a plurality of nozzles that deliver print agent onto a printable medium so as to print an image of a print job. Various tasks, such as maintenance tasks, may be performed in a printing system, e.g. in a large format ink-printer, before or after printing a print job. Such maintenance tasks performed before printing a print job may be for example a drop detection analysis.

BRIEF DESCRIPTION OF THE DRAWINGS

Various example features will be apparent from the detailed description which follows, taken in conjunction with the accompanying drawings, wherein.

DETAILED DESCRIPTION

Figure 1:
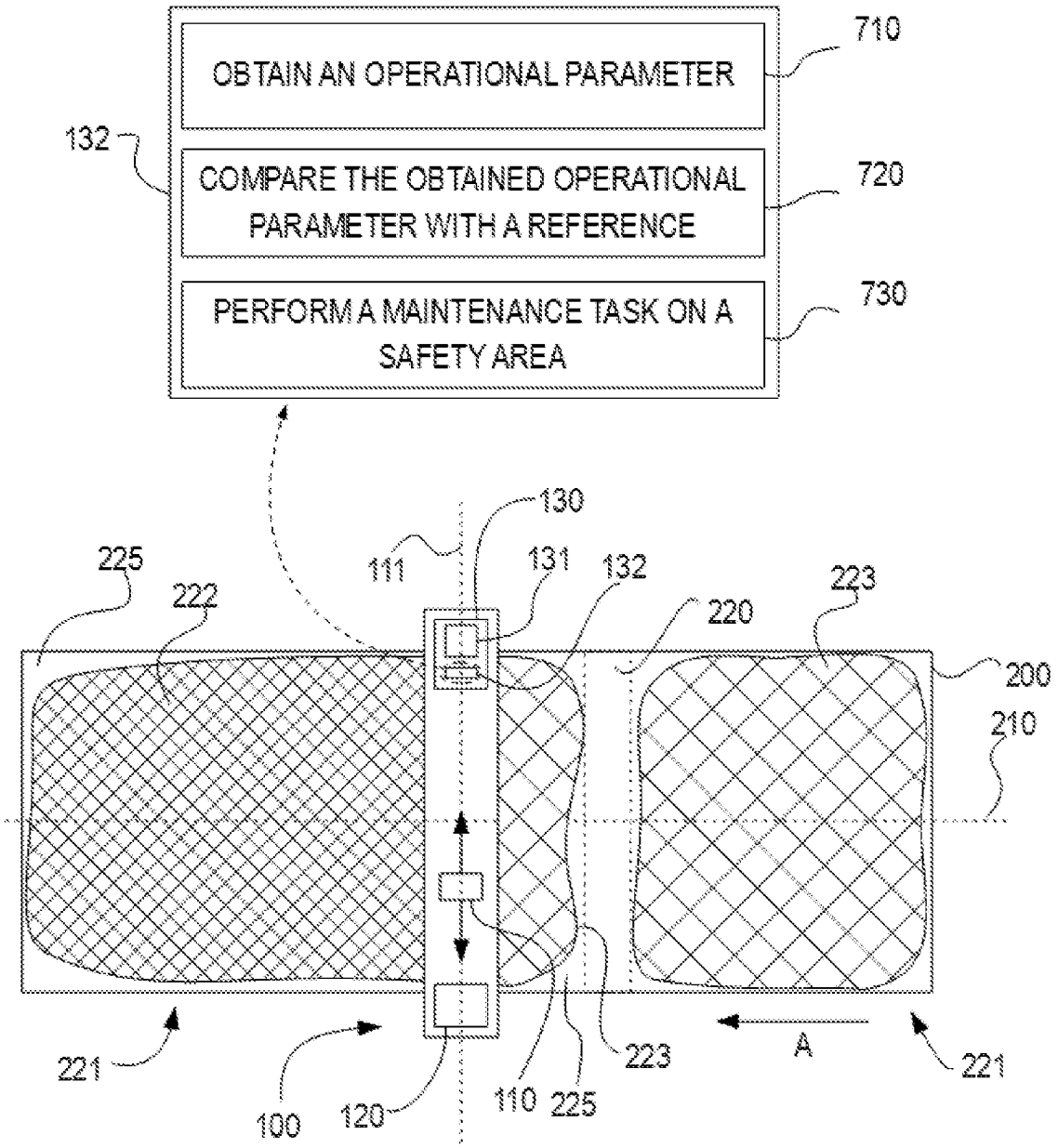
FIG. 1 schematically illustrates an example of a printing system according to the present disclosure and a zoom-in view schematically representing an example of a non-transitory machine readable storage medium according to the present disclosure.

A printing system comprises a print head which may deliver print agent onto a printable medium, e.g. paper sheet. The print head may be provided with a plurality of nozzles to deliver print agent, e.g. ink, onto the printable medium so as to print an image of a print job.

In some examples, the print head may travel repeatedly across a scan axis for delivering print agent onto a printable medium which may advance along an advancing axis. The scan axis may be substantially perpendicular to the advancing axis. The print head may be mounted on a carriage for moving across the scan axis. In some examples, several print heads may be mounted on a carriage. In some examples, four print heads may be mounted on a single carriage. In some examples, eight print heads may be mounted on a single carriage.

In some examples, the print head may be static. The print head may extend along a width of a printable medium. The plurality of nozzles may be distributed within the print head along the width of the printable medium. The width of the printable may be substantially perpendicular to an advancing axis of the printable medium. Such an arrangement may allow most of the width of the printable medium to be printed simultaneously. These printer systems may be called as page-wide array (PWA) printer systems.

A controller may control print agent delivered by the plurality of nozzles onto the printable medium to follow an image pattern of the print job. The image pattern may be analyzed by for example a processor before delivering print agent onto the printable medium. In some examples, the image pattern to be printed may be analyzed before starting the print job.

Before printing a print job, i.e. before starting a print job, various maintenance tasks may be performed. Examples of these maintenance tasks may be drop detection analysis, detecting skew of a printable medium or testing a sensor indicating a position of a print head. Performing these tasks may involve printing tests which may cause printing faults or defects. For example, in case of a drop detection analysis, the drop detection analysis may cause defects on a portion of a printing area of the printable medium. Defects caused by a drop detection analysis may be drying banding, print heads banding and grain differences. The printing quality of the printed area beneath the plurality of nozzles when the maintenance task is being performed or just after performing this maintenance task may be negatively affected. These defects may occur due to a time elapsed between the use of a particular nozzle, e.g. when a drop detection analysis is performed to the plurality of nozzles. These defects may also continue after a time following the maintenance task.

Printing a print job may involve printing large areas of a printable medium. For example, printable mediums having a length over 100 meters may be printed in a print job. Print jobs involving large or long printing areas, e.g. longer than 100 meters may be called as long print jobs. These long print jobs may also involve long times and may use a considerable quantity of print agent, e.g. ink. For example, printing a long print job may last more than 1 hour. Length and/or time of print jobs are becoming longer and longer, in particular in textile sector which may even employ print jobs longer than for example 300 meters.

In textile sector, an image may be directly printed on a textile material or indirectly by using a dye sublimation process. Dye sublimation (also known in the art as "dye-sub") is a process to print on substrates, e.g. polyester based substrates and polyester coated substrates. Some dye-sub methods may involve printing an image onto a sublimation transfer printable medium, e.g. paper, with a printing system and transferring this image to a final substrate, e.g. to a polyester fabric or to a polymer-coated substrate fabric. After the image is printed onto the sublimation transfer printable medium, it is placed on a heat press with the substrate to be sublimated. Applying heat and time, the image of the sublimation transfer printable medium is transferred to the final substrate.

In this disclosure, a print job refers to a unit of work to be run on a printing system for printing a text and/or an image. It applies to any text or images which can be printed in any size and may be used in for example in textiles applications, such as sportswear, multiple-page brochures and posters. A print job may comprise a single image or a plurality of images. A print job may be assigned with a unique job number and can comprise one or more files.

Print jobs involving long printing areas, e.g. longer than 100 meters, and/or long times, e.g. longer than 1 hour, may be unattended to reduce manufacturing costs. Unattended print jobs are not continuously inspected or verified by an operator. For this reason, printing defects during printing may not be immediately detected and these print jobs can thus be rejected after finishing. In addition, in particular in long print jobs, printing quality may decrease along print jobs. For example, nozzle health status may decrease with time and the ejection behavior of the nozzles may thus vary. Nozzles may suffer from mechanical or electrical faults. For example, some nozzles may get clogged. In some examples, temperature of print agent delivered by some nozzles may also be different, which may modify a color of the printed area.

This decrease of quality along long print jobs may also cause the rejection of the print job. Rejection of print jobs may imply an extra cost since time, print agent and printable medium are wasted.

Examples of the methods and systems disclosed herein may be used to perform a maintenance task in an area of the printable medium which does not negatively affect the printing area of the print job.

FIG. 1 schematically illustrates an example of a printing system 100 according to the present disclosure. The printing system 100 comprises a print head 110 having a plurality of nozzles (not shown in FIG. 1) to deliver print agent. Print agent may be delivered onto a printable medium 200. In this disclosure, delivering includes firing, ejecting, spitting or otherwise depositing print agent or ink. The printing system 100 further comprises a drop detector 120 to perform a drop detection analysis on the plurality of nozzles.

In some examples, a heating element may cause a rapid vaporization of print agent in a print agent chamber, increasing an internal pressure inside this print agent chamber. This increase in pressure makes a drop of print agent exit from the print agent chamber to the printable medium through a nozzle. These printing systems may be called as thermal inkjet printing systems.

In some examples, a piezo electric may be used to force a drop of print agent to be delivered from a print agent chamber onto the printable medium through a nozzle. A voltage may be applied to the piezo electric, which may change its shape. This change of shape may force a drop of print agent to exit through the nozzle. These printing systems may be called as piezo electric printing systems.

The printable medium 200 may advance or move along the advancing axis 210 following the direction represented by arrow A. The printable medium may be moved by an advancer (not shown in FIG. 1). An advancer may include a roller and/or a wheel. The printable medium 200 may be of any shape or size to be used in the printing system.

The printable medium is a material capable of receiving a print agent, e.g. ink. In some examples, the printable medium may be a sheet of paper. This sheet of paper may be used in a subsequent dye sublimation process. In some examples, the printable medium may a sheet of cardboard, textile material or plastic material.

The print head 110 may travel across a scan axis 111 for delivering print agent onto a width of the printable medium 200. In this disclosure, a width of a printable medium extends substantially perpendicular to the advancing axis 210 and a length of a printable medium extends substantially parallel to the advancing axis 210. The print head 110 may be mounted on a carriage (not shown in FIG. 1). In some examples four print heads may be mounted on a carriage. In some examples, eight print heads may be mounted on a carriage.

In some examples, the print head may statically span substantially the whole width of the printable medium. The print head may be used in a page-wide array (PWA) printing system.

The print head 110 of FIG. 1 comprises a plurality of nozzles. Nozzles of the plurality of nozzles may be placed in subgroups. The subgroups may comprise nozzles grouped in rows, i.e. parallel to the scan axis 111, and in columns, i.e. parallel to advancing axis 210. Longer rows may lead to swaths having a greater height (in the advancing axis 210) if all nozzles were to deliver print agent. In this disclosure, a swath refers to an area of a printable medium that can be printed by a print head in a single pass, i.e. from one lateral side of the printable medium to the opposite side along the scan axis 111. In some examples, the print head may deliver print agent on both on the way and the way back.

The printing system 100 of FIG. 1 comprises a controller 130 to compare an operational parameter of a print job with a reference operational parameter, to identify a safety area 220 to perform a maintenance task during a print job, to determine to perform a maintenance task during a print job based on at least a result of comparing the operational parameter with the reference operational parameter and of identifying a safety area, and to instruct the printing system to perform a maintenance task on the identified safety area 220 when a maintenance task is to be performed.

An operational parameter of a print job may comprise a length of the print job, a printing time of the print job or a time from a last maintenance task. The operational parameter is compared with a reference operational parameter and this comparison may indicate if the print job is a long print job, i.e. involving long print substrate and long print duration.

For example, the controller 130 may compare a length of a print job with a reference operational parameter. This reference operational parameter, in the example wherein the operational parameter is the job length, may be for example 100 meters. If the length of the print job is longer than the reference operational parameter, this may indicate that a long print job is detected. As previously described, a quality of the print job may decrease along long print jobs.

The controller may also identify a safety area 220 for performing a maintenance task. A safety area 220 of a printable medium 200 refers to an area in which printing defects may be acceptable since do not substantially negatively affect the final printed image. In some examples, the safety area 220 may have a height along the advancing axis 210 to allow the head printer 110 to perform one or more swaths. In some examples, several swaths, e.g. from 2 to 10, may be performed over the safety area.

The controller may determine to perform a maintenance task based on a result of comparing the operational parameter with the reference operational parameter, e.g. if the print job is a long print job, and of identifying a safety area. For example, if a safety area is not identified, then performing a maintenance task is not to be determined.

A maintenance task may thus be performed when the print head 110 is over the safety area 220. Consequently, defects caused by the maintenance task may be entirely comprised in the safety area 220. Therefore, performing maintenance tasks or tests do not negatively affect the image printed or to be printed on the printable medium 200. For example, a drop detection analysis may be performed when the printed head is placed substantially over a portion of a safety area. In some examples, several swaths may be performed after the drop detection analysis within the safety area 200.

Maintenance tasks during printing a long print job may thus be performed. These maintenance tasks may increase image quality and may reduce quality defects in print jobs. In addition, quality defects can be detected in advance by carrying out maintenance or preventive tasks, e.g. drop detection analysis, rather than a visual inspection. Malfunctioning of the printing system or of a component of the printing system may thus be early detected. As a result, print job rejections may be reduced and manufacturing costs may also be reduced.

A drop detection analysis is an example of a maintenance task. In some examples, the print head 110 may be moved towards the drop detector 120 to perform a drop detection analysis. In some examples, the drop detector may move along the print head to perform a drop detection analysis. A drop detection analysis may comprise analyzing a behavior of the plurality of nozzles. The drop detector 120 may detect drops fired, i.e. delivered, by each of the nozzles of the plurality of nozzles. The drop detector 120 may comprise a transmitter and a receiver, positioned spaced apart from the transmitter to allow a drop of print agent to pass between the transmitter and the receiver. The transmitter may be a led and the receiver a light sensor. The transmitter may emit a signal, e.g. a light signal, towards the receiver. The drop detector may determine if a drop of print agent is passing between the receiver and the transmitter. The drop detector may also provide with information about the characteristics of the drop of print agent and about the nozzle. In some examples, the receiver may detect a shadow produced by the drop of print agent. This shadow may be measured and may be used to determine characteristics of the drop of print agent. Nozzles out of the plurality of nozzles may thus be determined.

In some examples, the drop detector 120 may be used to detect nozzles out of the plurality of nozzles of the print head 110. A corrective strategy for these nozzles out may thus be implemented. In some examples, a corrective strategy may comprise controlling a quantity of print agent delivered by a nozzle or a group of nozzles adjacent to the nozzles out to compensate these nozzles out, i.e. not delivering print agent. For example, a nozzle surrounding a nozzle out may increase a quantity of ink ejected to compensate the nozzle out. This strategy may be called as an error hiding strategy. In some examples, a corrective strategy may comprise a recovery strategy involving clearing the plurality of nozzles or some nozzles of the plurality of nozzles, e.g. the nozzles out. For example, spitting print agent from a nozzle may serve to clean this nozzle and may prevent this nozzle from becoming blocked. In some examples, a corrective strategy may comprise a recovery strategy and an error hiding strategy.

In some examples, the controller 130 may control the print agent, e.g. ink, ejected by the plurality of nozzles. In some examples, a specific print agent controller may be used to control the print agent delivered by the plurality of nozzles. In some examples, each of the nozzles of the plurality of nozzles may be controlled independently to deliver print agent. In some examples, a group of nozzles of the plurality of nozzles may be independently controlled. In some examples, the print head may comprise resistances associated with the plurality of nozzles. For example, a resistance associated with a nozzle may cause this nozzle to fire and print agent may thus be delivered. An extensive use of some nozzles may thus produce an increase in a temperature of these nozzles and of print agent delivered by them. In some examples, the print head may comprise a temperature sensor to measure a temperature of the plurality of nozzles or of a group of nozzles of the plurality of nozzles.

In some examples, at least depending on a result of comparing an operational parameter of a print job with a reference operational parameter, a controller may determine not to perform a maintenance task. For example, the controller 130 of FIG. 1 may determine not to perform a maintenance task if the reference operational parameter is greater than the operational parameter of the print job. This decision may rely on the fact that maintenance operations are not of use in short print jobs.

The printable medium 200 of FIG. 1 schematically represents a printable medium of a print job. The printable medium 200 comprises a printing area 221. In this figure, the printing area is represented by a crosshatch pattern. The printing area 221 may comprise a printed portion 222 and a portion to be printed 223. The crosshatch pattern of the portion to be printed 223 has bigger squares than the crosshatch pattern of the printed portion 222. The printing area 221 may comprise one image or several images comprised in a single print job. In the example of FIG. 1, a first image comprises a printed portion 222 and a portion to be printed 223 and a second image comprises a portion to be printed 223 and not a printed portion.

The printable medium may also comprise a non-printing area 225. In this example, the non-printing area 225 comprises a safety area 220. In this figure, the safety area 220 is identified between two images. The print head 110 may perform one or more swaths over the safety area 220. The printable medium 200 may advance towards the position of the print head 110 and, a maintenance task may be performed when the print head 110 is located over the safety area 220.

In some examples, a safety area may correspond to an area of the printable medium not present on the final product. For example, a safety area may correspond to cutting marks, e.g., an area adjacent and/or including cutting marks.

The controller 130 may further control the printing system to perform maintenance tasks. For example, the controller 130 may control the drop detector 120 to perform a drop detection analysis.

In FIG. 1, the controller 130 includes a processor 131 and a non-transitory machine readable storage medium 132. The non-transitory machine readable storage medium 132 is coupled to the processor 131.

The processor 131 performs operations on data. In an example, the processor is an application specific processor, for example a processor dedicated to control executing a maintenance task. The processor 131 may also be a central processing unit for controlling the operation of the printing system.

The non-transitory machine readable storage medium 132 may include any electronic, magnetic, optical, or other physical storage device that stores executable instructions. The non-transitory machine-readable storage medium 132 may be, for example, Random Access Memory (RAM), an Electrically-Erasable Programmable Read-Only Memory (EEPROM), a storage drive, an optical disk, and the like.

FIG. 1 additionally comprises a zoom-in view schematically representing an example of a non-transitory machine-readable storage medium 132 according to the present disclosure. The non-transitory machine-readable storage medium 132 is encoded with instructions which, when executed by the processor 131, cause the processor 131 to obtain an operational parameter of a print job as represented at block 710, compare the obtained operational parameter with a reference operational parameter as represented at block 720, and perform a maintenance task on a safety area 220 of a printable medium 200 based on at least a result of comparing the obtained operational parameter with the reference operational parameter as represented at block 730.

An operational parameter may be obtained by analyzing the print job before starting to print. The processor 131 or an external processor may analyze the print job. In some examples, a processor may determine or calculate the length of the print job. In some examples, the processor may obtain from a sensor the length of the print job. In some examples, a processor may determine or calculate a time or an amount of print agent for printing a print job. In some examples, a processor may determine a time from a last maintenance task. Accordingly, several inputs may be used to determine whether to carry out a maintenance task or not.

Performing a maintenance task of block 730 may include instructing a print system to perform a maintenance task. The processor 131 may control a drop detection analysis performed by the drop detector 120. A safety area 220 for performing a maintenance operation without affecting the remaining portions of the printable medium may be determined by the processor 131. The processor may decide to perform a maintenance task during a print job if the obtained operational parameter is greater than a reference operational parameter. Deciding whether to perform or not a maintenance operation may also take into account if a safety zone may be detected during the print job. For example, if no safety zone may be determined, the processor may decide not to perform a maintenance task to avoid defects caused by this task on the printing area 221.

The instructions encoded in the non-transitory machine readable storage medium for the processor represented at blocks 710, 720 and 730 may participate in printing a print job during which maintenance operations may be performed in zones not interfering with the printing areas.

Figure 2:
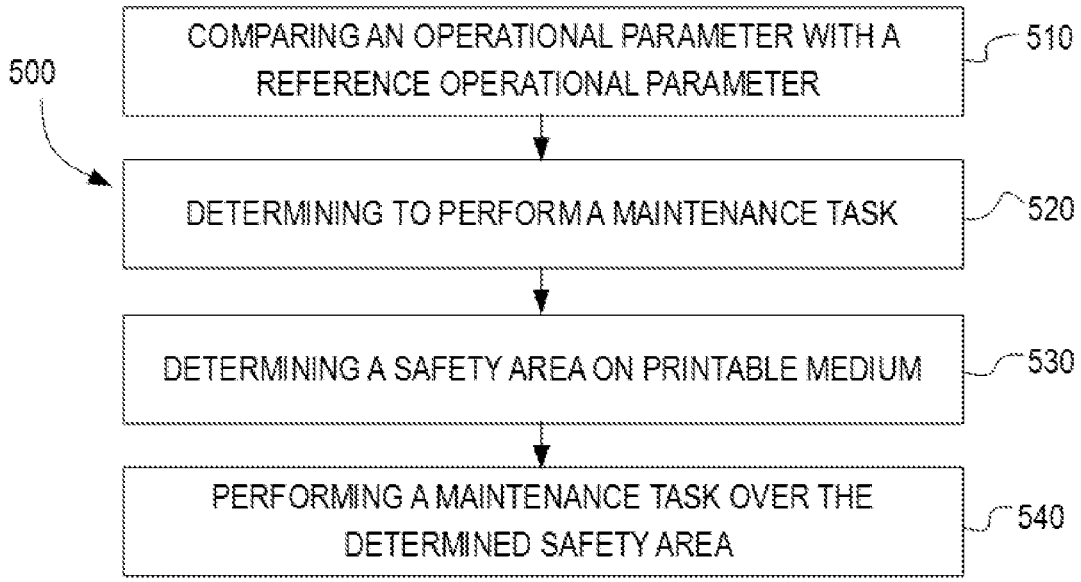
FIG. 2 is a block diagram of an example of a method to print a print job according to the present disclosure.

FIG. 2 is a block diagram of an example of a method 500 to print a print job according to the present disclosure.

In some examples, the method 500 may be applied to any of the examples of printing systems herein described.

In some examples, the printing systems and the non-transitory machine readable storage medium may be used for performing the method 500 to print a print job.

Block 510 represents comparing an operational parameter of the print job with a reference operational parameter. In some examples, the operational parameter may be a length of the print job, a printing time of the print job or a time from a last maintenance task. The reference operational parameter may accordingly be a reference length, a reference printing time or a reference time from a last maintenance task. The operational parameter may indicate if the print job involves long times and/or long printable mediums. Long times or long print printable mediums may involve using a large amount of print agent.

At block 520 determining to perform a maintenance task during the print job based on at least a result of comparing the operational parameter with the reference operational parameter is represented. A comparison between the operational parameter and the reference operational parameter may thus be used to determine to perform a maintenance task.

An operational parameter greater than a threshold or a reference operational parameter may indicate that the print job involves a long printing time, a long printing area or a large amount of print agent. A decrease of printing quality can thus be expected when the operational parameter is greater than the reference operational parameter. Therefore, the method may determine to perform a maintenance task to maintain printing quality.

If an operational parameter is less than a reference operational parameter, printing quality along the whole print job is expected not to substantially decrease. This may be the case in short print jobs, e.g. involving a short length of printable medium. As the length is relatively short, the printing quality along the whole print job may be maintained under certain limits. In some examples, if the operational parameter is less than the reference operational parameter, the method may determine not to perform the maintenance task. A cost-benefit analysis of performing a maintenance task may thus be taken into account. Maintenance tasks during printing the print job may thus be avoided if performing these maintenance tasks is not cost-effective. As a result, printing efficiency may be increased.

In some examples, the method may comprise continuing to print job if the maintenance task is not to be performed.

The method may thus detect if printing quality is expected to be maintained along the print job or to be substantially decreased.

At block 530 determining a safety area on a printable medium if a maintenance task is to be performed is represented. A safety area of a printable medium refers to an area of the printable medium in which a print head of the printing system may be positioned when maintenance tasks are performed without interfering with a printing image. If maintenance tasks are performed when a print head of the printing system is temporary over the safety area, the printing area is not polluted by the maintenance tasks. Therefore, performing maintenance tasks or tests on the safety area do not negatively affect the image printed or to be printed on the printable medium.

The safety area may correspond to a non-printing area between printing areas or to areas of the printable medium not present on the final product.

Performing the maintenance task over the determined safety area is represented at block 540. Maintenance tasks may improve printing quality. In some examples, performing the maintenance task may comprise a drop detection analysis, detecting skew of the printable medium or testing a sensor indicating a position of a print head. In some examples, a maintenance task may be a combination of any of them.

A malfunctioning of a print head, e.g. having some blocked nozzles, may reduce an image quality. Performing a drop detection analysis may detect if a print head is not working correctly.

In some examples, a drop detection analysis may comprise detecting nozzles out of a plurality of nozzles of a print head and implementing a corrective strategy. In some examples, a corrective strategy may comprise an error hiding strategy. An error hiding strategy may comprise controlling a quantity of print agent delivered by a nozzle or a group of nozzles adjacent to the nozzles out to compensate these nozzles out. In some examples, a corrective strategy may comprise a recovery strategy to clear or the plurality of nozzles or some of the plurality of nozzles, e.g. the nozzles out. Clearing or cleaning a nozzle may comprise spitting a large amount of print agent from the nozzle. In some examples, a corrective strategy may comprise a recovery strategy and an error hiding strategy.

In some examples, the printable medium may advance skewed with respect to an advancing axis, i.e. not advancing perpendicular to the movement of a print head. The image may thus be printed slanted. A skewed printable medium may cause the rejection of the print job. Detecting skew of the printable medium may thus improve the efficiency of the printing process. After detecting that the printable medium is skewed, the advancing direction of the printable medium may be corrected.

In some examples, the print head may comprise a sensor for indicating the position of the print head. The sensor may indicate an erroneous position of the print head. For example, the sensor may get dirty. As the sensor provides an erroneous position of the print head, the image is not correctly printed. If this sensor is not working correctly, this sensor may then have to be fixed or replaced.

In some examples, determining a safety area on a printable medium may comprise analyzing an image pattern of the print job to identify a non-printing area on the printable medium. The image pattern may be analyzed before starting printing and safety areas across the printable medium can be selected. A controller may be used to analyze an image pattern of the print job.

In some examples, an operational parameter may be determined before starting the print job. In some examples, an operational parameter and a safety area may be determined before starting the print job. Maintenance tasks may thus be prepared in advance.

In some examples, determining a safety area on a printable medium may comprise determining if a print head is not delivering print agent on the printable medium. This may indicate that a non-printing area is under the print head. This non-printing area may be a safety area.

In some examples, determining if a print head is not delivering print agent may comprise detecting a print head movement along a scan axis. In some examples, determining if a print head is not delivering a print agent may comprise measuring a temperature of the print head. A reduction of a temperature of a print head may indicate that nozzles of the print head are not firing print agent, i.e. the print head is not working. In some examples, determining if a print head is not delivering print agent may comprise determining a quantity of print agent delivered from the print head from starting the print job.

In some examples, a safety area may be determined by a combination of any of the examples herein described.

In some examples, a safety area cannot be determined. This may occur when there are no non-printing areas on the printable medium, e.g. the print job comprises a single image extending across the whole printable medium. The method may thus comprise continuing to print the print job without performing a maintenance task if a safety area cannot be determined.

In some examples, the method may comprise determining a status condition of the print job. Determining to perform a maintenance task is further based on the determined status condition of the print job. Therefore, in order to determine to perform a maintenance task, both comparing an operational parameter with the reference operational parameter and the status condition of the print job may be taken into account. The status condition of the print job may indicate a percentage of the print job done or a progress of the print job. The status condition of the print job may indicate for example that the print job has just recently started or that is about to finish.

A status condition of a print job may comprise a length of the printable medium printed from starting the print job, a length of the printable medium pending to be printed to finish the print job, a printing time from starting the print job or a printing time to finish the print job.

A length of the printable medium from starting the print job or a printing time from starting the print job may be used to indicate that the print job is in its beginning. A length of the printable medium pending to be printed to finish the print job or a printing time to finish the print job may be used to indicate that the print job is about to finish.

In some examples, the operational parameter may be greater than the reference operational parameter and the print job may have just started. Although a decrease of printing quality may be expected along the print job, the print job is in its beginning and therefore a decrease of quality is not expected at this time. Before starting a print job, a maintenance tasks may be performed. According to this aspect, performing a maintenance task just after starting the print job does not substantially increase the performance of the printing process.

In some examples, the method may comprises determining not to perform a maintenance task if the length of the printable medium printed from starting the print job or if the printing time from starting the print job is less than a start threshold. In some examples, the start threshold may be 20 meters. In some examples, the start threshold may be 15 minutes.

In some examples, the operational parameter may be greater than the reference operational parameter and the print job may be about to finish. As the print job is about to finish, performing a maintenance task does not substantially improve the quality of the whole print job. Maintenance tasks may involve stopping printing. As performing a maintenance task when the print job is about to finish may not to provide a significant benefit to maintain image quality robustness along the print job. Time employed to perform a maintenance task may thus be a waste of time. Therefore, performing a maintenance task when the print job is about to finish does not substantially increase the performance of the printing process.

The method may comprise determining not to perform a maintenance task if the length of the printable medium to be printed or if the printing time to finish the print job is less than an end threshold. In some examples, the end threshold may be 10 meters. In some examples, the end threshold may be 10 minutes.

Therefore, maintenance tasks not improving the efficiency of the printing process may be prevented by using the information provided by the status condition of the print job. Therefore, the efficiency of the printing process may be increased by taking into account the status condition of the print job, since maintenance tasks not substantially improving the printing quality along the print job are not performed.

Figure 3:
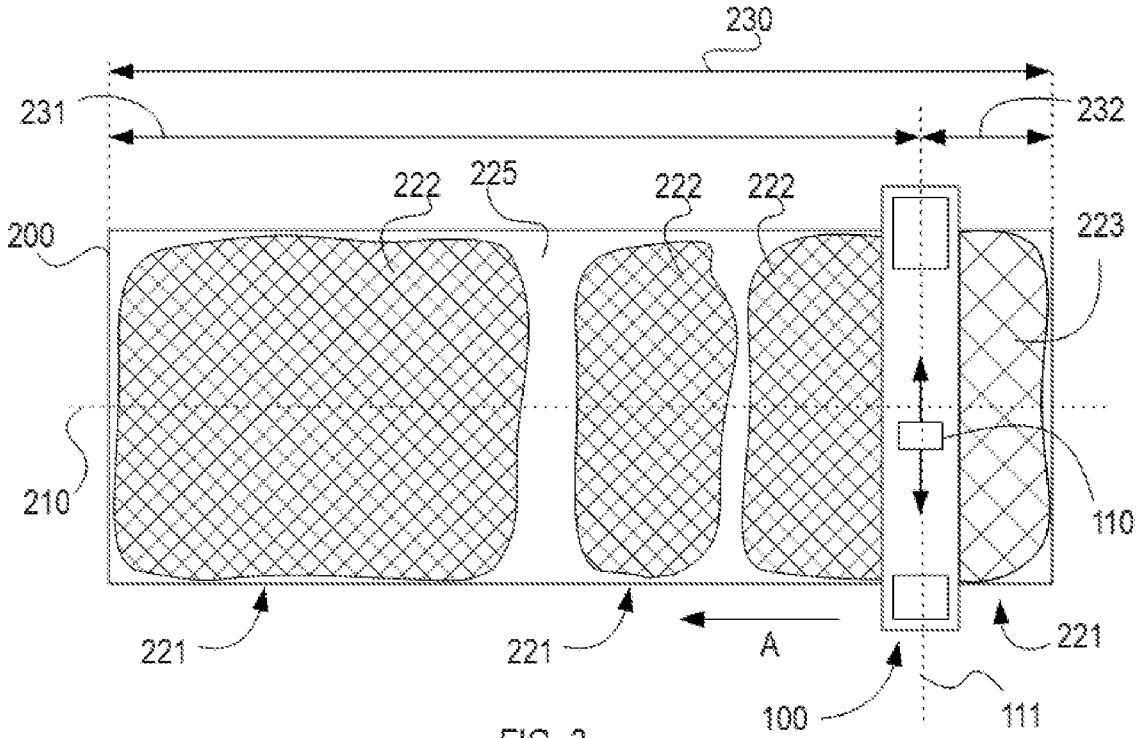
FIG. 3 schematically illustrates an example of a printing system performing a method to print a print job according to one example of the present disclosure in which the print job is about to finish.

FIG. 3 schematically illustrates an example of a printing system performing a method to print a print job according to one example of the present disclosure in which the print job is about to finish.

The printable medium 200 of a print job of FIG. 3 comprises three printing areas 221 and a non-printing area 225. A printing area represents an area of the printable medium in which an image has been printed or is to be printed. Reference 222 represents printed portions of the printing area, i.e. images printed, and reference 223 represents portions of the printing area to be printed. In FIG. 3 one portion of the printing area 221 is being printed by delivering print agent from a print head 110 of a print system 100 which moves along the scan axis 111.

The print job of FIG. 3 comprises a length 230 extending parallel to the advancing axis 210. The printable medium 200 may advance along the advancing axis 210 with a direction represented by the arrow A. A length of the printable medium pending to be printed to finish the print job is represented by 232. A length of the printable medium from starting the print job is represented by 231. A length to pending to be printed 232 may be a length between the scan axis 111 and an end side of the printable medium 200 extending across the advancing axis 210. A length of the printable medium form starting the print job 231 may be a length between the scan axis 111 and a start side of the print job.

In the example of FIG. 3, a length of the print job 230 may be compared with a reference length. Performing a maintenance task may be determined based on comparing the length of the print job 230 with a reference operational parameter.

A length of the printable medium pending to be printed 232 or a length of the printable medium from starting the print job 231 may also be taken into account to determine whether to perform a maintenance task or not.

For example, in FIG. 3 the length of the print job 230 is higher than a reference operational parameter. A long print job may thus be detected. Therefore, a maintenance task may be determined to be performed. However, if a status condition of the print job is determined, this determined status condition may additionally be taking in to account to assess whether to perform or not a maintenance task. In this example, a length of the printable medium pending to be printed 232 is less than an end threshold, e.g. an end length threshold. Therefore, the method may determine performing a maintenance task based on comparing the length of the print job 230 with a reference operational parameter and on comparing the length of the printable medium pending to be printed 232 with an end threshold. As in FIG. 3 the length of the printable medium pending to be printed 232 is less than an end threshold, not to perform a maintenance task is determined. The print system may continue printing to finish the print job.

Figure 4:
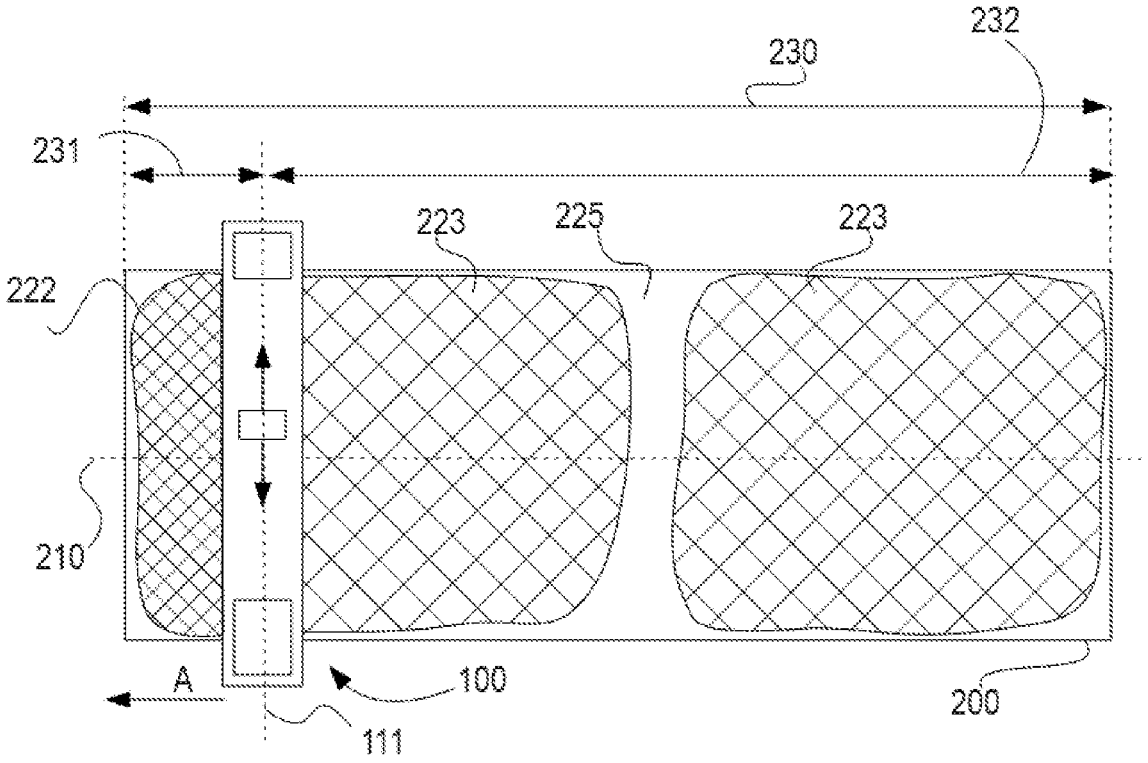
FIG. 4 schematically illustrates an example of a printing system performing a method to print a print job according to one example of the present disclosure in which the print job has recently started.

FIG. 4 schematically illustrates an example of a printing system performing a method to print a print job according to one example of the present disclosure in which the print job has recently started. In this example, a length 230 of the print job is greater than a reference operational parameter.

In FIG. 4 the portion 222 has been already printed and the portions 223 are areas pending to be printed. A length from the scanning axis 111 to the start side of the printable medium along the advancing axis 210 is represented by 231. In this figure, the length 231 is less than a start threshold. The length of the printable medium printed from starting the print job 231 may be used to determine to perform a maintenance task. In this example, if a status of the print job is also taken into account for determining to perform a maintenance task, the method will determine not to perform a maintenance task. The printing system may thus continue to print the print job.

However, as the printable medium 200 may advance following the arrow A, the length of the printable medium printed from starting the job 231 may also increase with time. At some point, this length 231 may then be greater than a start threshold. Accordingly, performing a maintenance task may be determined. A safety area on the printable may be determined. In FIG. 4 a safety area (not represented in FIG. 4) may be identified in a portion of the non-printing area 225 between the two images. After positioning the print head of the printing system over the determined safety area, a maintenance task can be performed.

Figure 5:
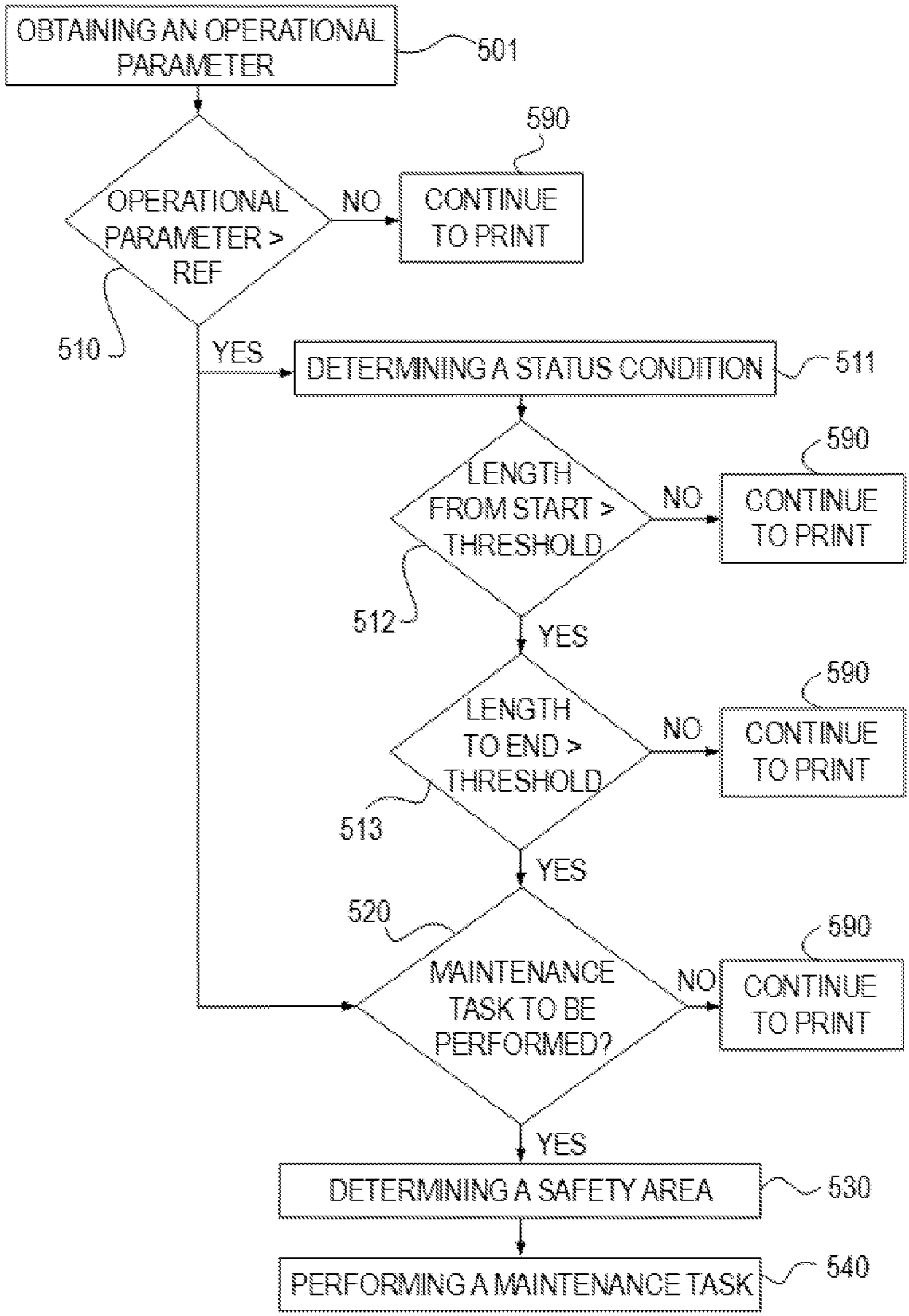
FIG. 5 is a block diagram of another example of a method to print a print job according to the present disclosure.

FIG. 5 is a block diagram of another example of a method 500 to print a print job according to the present disclosure.

Block 501 represents obtaining an operational parameter. A processor, integrated in a printing system or a separate processor may analyze the print job to calculate an operational parameter. A sensor may obtain an operational parameter of the print job. For example, this sensor may be in the printing system. A controller may obtain an operational for example calculated by a processor or measured by a sensor.

The obtained operational parameter is compared with a reference operational parameter at block 510. If the operational parameter is less than the reference operational parameter, then printing system continues to print as represented at block 590. If the operational parameter is greater than the reference operational parameter, then a status condition of the print job is determined as represented at block 511.

The reference operational parameter may be a length of the print job. In some examples, a reference operational parameter may be a length between 100 and 300 meters. For example, a reference operational parameter may be 100, 200 or 300 meters.

The reference operational parameter may be a time, e.g. a time from a last maintenance task or a printing time of the print job. In some examples, a reference operational parameter may be a time between 1 and 2 hours. For example, a reference operational parameter may be 60, 90 or 120 minutes.

Determining a status condition of block 511 may indicate the progress of the print job. In this example, a length of the printable medium printed from the start of the print job and a length of the printable medium pending to be printing along the print job are determined. In some examples, these lengths may be for example calculated by a controller. In some examples, a sensor, e.g. an optic sensor, may measure a printed area of the printable medium.

At block 512 a length of the printable medium printed from the start of the print job is compared with a start length threshold. If the printed length is less than the start length threshold, then the printing system continues to print the print job. This may indicate that the print job has recently started. A start length threshold may be a length between 5 and 30 meters. For example, the start length threshold may be 5, 10, 20 or 30 meters.

If the printed length is greater than the start length threshold, then a length of the printable area pending to be printed is compared with an end length threshold as represented at block 513. If the length of the printable area pending to be printed is less than the end length threshold, then the printing system continues to print the print job. This may indicate that the print job is about to finish. If the length of the printable area pending to be printed is greater than the end length threshold, then performing or not a maintenance task is determined as represented at block 520. An end length threshold may be a length between 5 and 30 meters. For example, the end length threshold may be 5, 10, 20 or 30 meters.

In this example, lengths are used to indicate a status condition of the print job. In some examples, times may indicate a status condition of the print job. A start time threshold or an end time threshold may be between 5 and 20 minutes. For example, these time thresholds may be 5, 10, 15 or 20 minutes.

In this example, at block 520 both an operational parameter and a status condition are taken into account to determine to perform a maintenance task. If a maintenance task is determined to be performed, a safety area is determined as represented at block 530. A safety area may be determined according to any of the methods herein disclosed.

Block 540 represents performing a maintenance task on the safety area. The maintenance task may be any of the maintenance operations herein disclosed. If a safety area cannot be determined in the print job between these length constraints, i.e. between an area comprised between the length thresholds, then printing continues.

The preceding description has been presented to illustrate and describe certain examples. Different sets of examples have been described; these may be applied individually or in combination, sometimes with a synergetic effect. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

The invention claimed is:

1. A method to print a print job comprising:

comparing an operational parameter of the print job with a reference operational parameter;

determining to perform a maintenance task during the print job based on at least a result of comparing the operational parameter with the reference operational parameter;

if the maintenance task is to be performed:

determining a safety area on a printable medium;

performing the maintenance task over the determined safety area.

2. The method according to claim 1, wherein determining a safety area on a printable medium comprises analyzing the print job to identify a non-printing area on the printable medium.

3. The method according to claim 1, wherein determining a safety area on a printable medium comprises determining if a print head is not delivering print agent on the printable medium.

4. The method according to claim 3, wherein determining if a print head is not delivering print agent on the printable medium comprises measuring a temperature of the print head.

5. The method according to claim 1, wherein if the operational parameter is less than the reference operational parameter, then determining not to perform the maintenance task.

6. The method according to claim 1, wherein the operational parameter of the print job comprises a length of the print job, a printing time of the print job or a time from a last maintenance task.

7. The method according to claim 1, comprising determining a status condition of the print job, and wherein determining to perform a maintenance task is further based on the determined status condition of the print job.

8. The method according to claim 7, wherein the status condition of the print job comprises a length of the printable medium printed from starting the print job, a length of the printable medium pending to be printed to finish the print job, a printing time from starting the print job or a printing time to finish the print job.

9. The method according to claim 8, wherein if the length of the printable medium pending to be printed to finish the print job or if the printing time to finish the print job is less than an end threshold, then determining not to perform the maintenance task.

10. The method according to claim 8, wherein if the length of the printable medium printed from starting the print job or if the printing time from starting the print job is less than a start threshold, then determining not to perform the maintenance task.

11. The method according to claim 1, wherein performing the maintenance task comprises a drop detection analysis, detecting skew of the printable medium or testing a sensor indicating a position of a print head.

12. The method according to claim 11, wherein the maintenance task comprises a drop detection analysis, the drop detection analysis comprising detecting nozzles out of a plurality of nozzles of a print head and implementing a corrective strategy.

13. The method according to claim 1, comprising continuing to print the print job if the maintenance task is not to be performed.

14. A printing system comprising:

a print head having a plurality of nozzles to deliver print agent;

a drop detector to perform a drop detection analysis on the plurality of nozzles; and a controller to:

compare an operational parameter of a print job with a reference operational parameter;

identify a safety area to perform a maintenance task during a print job;

determine to perform a maintenance task during a print job based on at least a result of comparing the operational parameter with the reference operational parameter and of identifying a safety area;

instruct the printing system to perform a maintenance task on the identified safety area when a maintenance task is to be performed.

15. A non-transitory machine readable storage medium encoded with instructions which when executed by a processor, cause the processor to:

obtain an operational parameter of a print job;

compare the obtained operational parameter with a reference operational parameter; and perform a maintenance task on a safety area of a printable medium based on at least a result of comparing the obtained operational parameter with the reference operational parameter.

* * * * *